US011027316B1

(12) United States Patent
Dubois

(10) Patent No.: US 11,027,316 B1
(45) Date of Patent: Jun. 8, 2021

(54) ULTRASONIC CHIP CLEANING BASKET AND SYSTEM

(71) Applicant: Clay Dubois, Las Vegas, NV (US)

(72) Inventor: Clay Dubois, Las Vegas, NV (US)

( * ) Notice: Subject to any disclaimer, the term of this patent is extended or adjusted under 35 U.S.C. 154(b) by 75 days.

(21) Appl. No.: 16/043,185

(22) Filed: Jul. 24, 2018

Related U.S. Application Data

(60) Provisional application No. 62/702,367, filed on Jul. 24, 2018.

(51) Int. Cl.

| | |
|---|---|
| ***B08B 3/12*** | (2006.01) |
| ***B65D 6/08*** | (2006.01) |
| ***A63F 11/00*** | (2006.01) |
| ***B65D 43/02*** | (2006.01) |
| ***B65D 55/02*** | (2006.01) |
| ***B65D 25/28*** | (2006.01) |

(52) U.S. Cl.
CPC ..... *B08B 3/12* (2013.01); *A63F 11/0002* (2013.01); *B65D 7/14* (2013.01); *B65D 11/14* (2013.01); *B65D 25/282* (2013.01); *B65D 43/0202* (2013.01); *B65D 55/02* (2013.01)

(58) Field of Classification Search
CPC ..... A63F 11/0002; B65D 7/16; B65D 7/14; B65D 11/14; B65D 55/02; B65D 25/282; B65D 25/2852; B65D 43/0202; B65D 43/02; B08B 3/12
USPC ..... 220/486, 485, 676, 553, 528, 494, 769
See application file for complete search history.

(56) References Cited

U.S. PATENT DOCUMENTS

| | | | | |
|---|---|---|---|---|
| 3,037,658 A * | 6/1962 | Schray | B65D 77/04 206/202 |
| 4,883,169 A * | 11/1989 | Flanagan, Jr. | B65D 71/0003 206/170 |
| 9,700,477 B1 * | 7/2017 | Franks | A61G 17/001 |
| 2010/0096806 A1 * | 4/2010 | Hextall | A63F 3/00 273/271 |

FOREIGN PATENT DOCUMENTS

WO WO-2019119032 A1 * 6/2019 ..... A63F 3/00094

OTHER PUBLICATIONS

Wikipedia, "Ultrasonic Cleaning", https://en.wikipedia.org/w/index.php?title=Ultrasonic_cleaning&oldid=849148818, Jul. 6, 2018.
Wikipedia, "Ultrasonic Transducer", https://en.wikipedia.org/w/index.php?title=Ultrasonic_transducer&oldid=836680627, Apr. 16, 2018.

(Continued)

*Primary Examiner* — Robert J Hicks
(74) *Attorney, Agent, or Firm* — Muskin and Farmer LLC

(57) ABSTRACT

A chip washing basket and a method for its use. The chip washing basket can hold casino chips and can provide a maximum amount of surface area for the chips to enable the basket to be utilized in an ultrasonic cleaner. The ultrasonic cleaner can operate while the chips are present in the basket, thereby cleaning the chips. The basket can have a plurality of vertical slots that the chips can be dropped into. The basket would have a plurality of vertical bars and a plurality of divider panels to secure the chips while exposing a large amount of surface area on the chips so the ultrasonic action inside the ultrasonic cleaner can clean the chips effectively.

13 Claims, 18 Drawing Sheets

(56) References Cited

OTHER PUBLICATIONS (Web page) TDN Money Systems Inc, "Chip Cleaning: 'Clean Play' Chip Cleaning Machine", https://web.archive.org/web/20190409031830/http://www.tdnmoney.com/product/clean-play-chip-cleaning-machine-2/, please treat as appearing before current filing date of Jul. 24, 2018. Also attached is 8 images on web page.

* cited by examiner 100
10
10
900
901
902

ULTRASONIC CHIP CLEANING BASKET AND SYSTEM

CROSS REFERENCE TO RELATED APPLICATIONS

This application claims benefit to U.S. provisional application 62/702,367, which is incorporated by reference herein in its entirety.

BACKGROUND OF THE INVENTION

Field of the Invention

The present general inventive concept is directed to a method and apparatus directed to ultrasonic chip cleaning.

Description of the Related Art

Casino chips are widely used to track wagers in a casino. Casino chips can be made out of various materials, such as clay, plastic, ceramics, etc. Given the smoky and high traffic typically present in casinos, casino chips over time can become very dirty with dirty embedded in the chips and hard to remove. Some casinos may replace their older chips over time, which costs money to retire old chips and purchase new ones.

What is needed is an improved way to clean casino chips.

SUMMARY OF THE INVENTION

It is an aspect of the present invention to provide an improved system and method to clean casino chips.

These together with other aspects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

Further features and advantages of the present invention, as well as the structure and operation of various embodiments of the present invention, will become apparent and more readily appreciated from the following description of the preferred embodiments, taken in conjunction with the accompanying drawings of which.

DESCRIPTION OF THE PREFERRED EMBODIMENTS

Figure 1A:
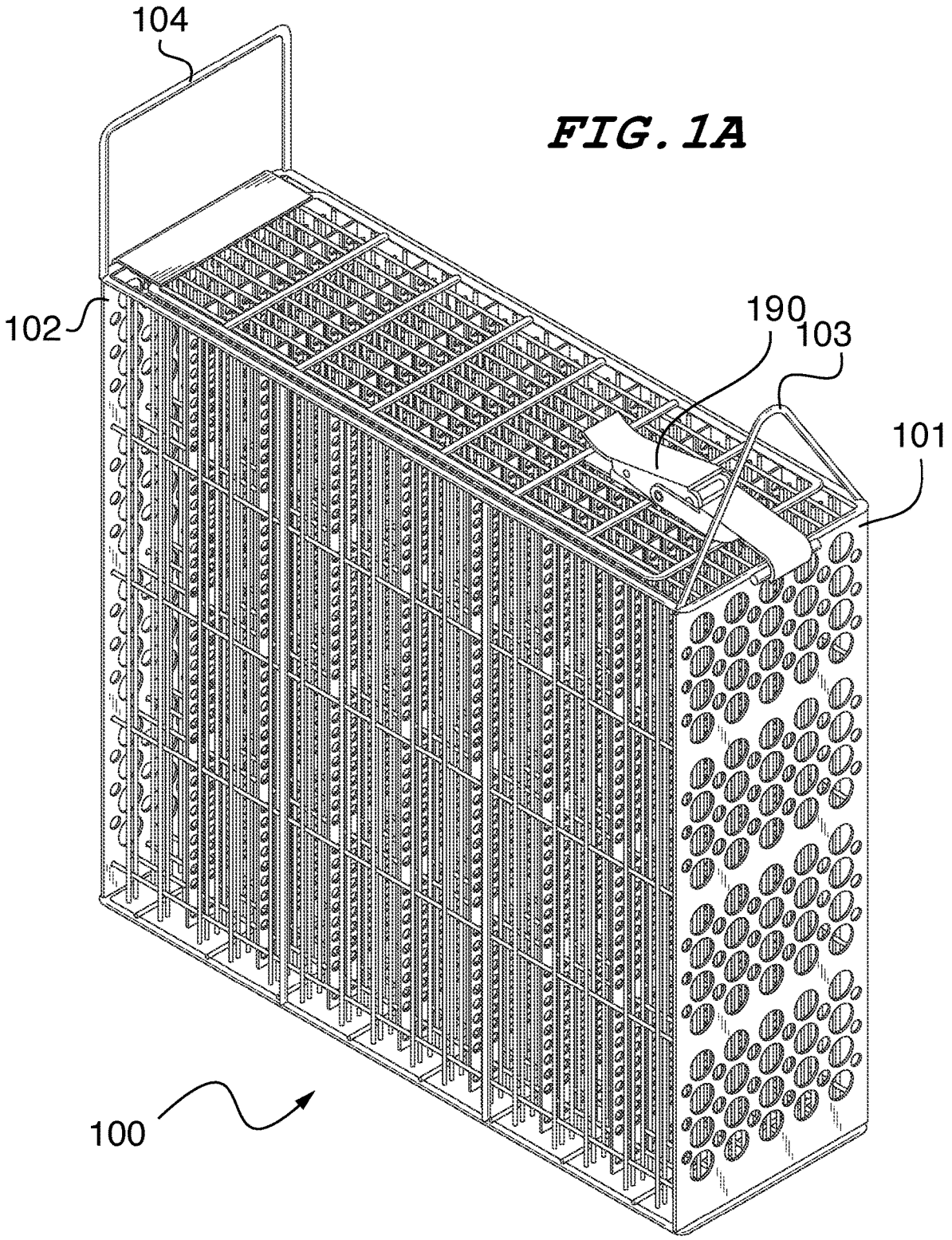
FIG. 1A is an isometric view of an empty chip washing basket, according to an embodiment.

Reference will now be made in detail to the presently preferred embodiments of the invention, examples of which are illustrated in the accompanying drawings, wherein like reference numerals refer to like elements throughout.

An ultrasonic cleaner/washer can be used to clean casino chips. An ultrasonic cleaner generates ultrasonic waves (e.g., via ultrasound generating transducers) which create compression waves. The compression waves result in millions of vacuum bubbles (cavitation). The bubbles have high temperatures and pressures and result in cleaning dirt and contaminants from articles being washed. A chip washing basket is used to efficiently house casino chips so that when the basket is inserted into an ultrasonic cleaner the ultrasonic cleaner is able to clean the entire surface of each chip most efficiently.

FIG. 1A is an isometric view of an empty chip washing basket, according to an embodiment.

A front handle 103 and a back handle 104 can be used to lift a chip washing basket 100. A front panel 101 and a back panel 102 are identical and have circular holes of different sizes as illustrated. While two different sized holes are used, it can be appreciated that the holes can be all of uniform size, or of a number of different sizes (e.g., 2 to 20 or more different sizes). The circular holes in the front panel 101 and the back panel 102 serve to maintain the structural stability of the chip washing basket 100 as well as letting the water (with cleaning solution) inside the chip washing basket 100 when the chip washing basket 100 in inserted inside an ultrasonic cleaner. Note that instead of circles, other shapes can be used for the holes in the font panel 101 and back panel 102, such as squares, ovals, rectangles, etc., or even a combination of different shapes. The chip washing basket 100 is designed to allow for idealwater flow through the basket so that the water has a lot of surface contact with the chips so that the ultrasonic process can work best and clean the chips.

A clasp 190 mounted on to the lid 300 locks the lid onto a top of the chip washing basket 100 so that the lid does not fall off. A hook on an end of the clasp 190 hooks onto a rod on a top (shown but not numbered) of the basket 100 and then a handle on the clasp 190 is pushed to tighten the clasp thereby securing the lid 300 onto the top of the chip washing basket 100. The clasp 190 can be removed by reversing this process (e.g., by lifting the handle on the clasp 190). Note that alternative to the shown clasp, any other mechanism can be used to attach the lid 300 to the basket 100.

Casino chips can be dropped (when the lid 300 is removed from the basket 100) into the chip washing basket 100. This particular example basket 100 can hold eight chips high by eight chips long by ten chips wide (for a maximum of 640 chips) that the basket 100 can hold at one time). Of course, the basket 100 can be configured to be other sizes as well and can hold other amounts of chips as well.

Between the front panel 101 and the back panel 102 are seven divider panels (each divider panel is oriented parallel to the front panel 101 and the back panel 102). Each divider panel is comprised of a plurality of divider strips (such as 10). Note that the divider strip has holes throughout it, although other shapes can be used as well (squares, ovals, different shapes, etc.) The holes in the divider strips can be of uniform size or of two or more different sizes.

Figure 1B:
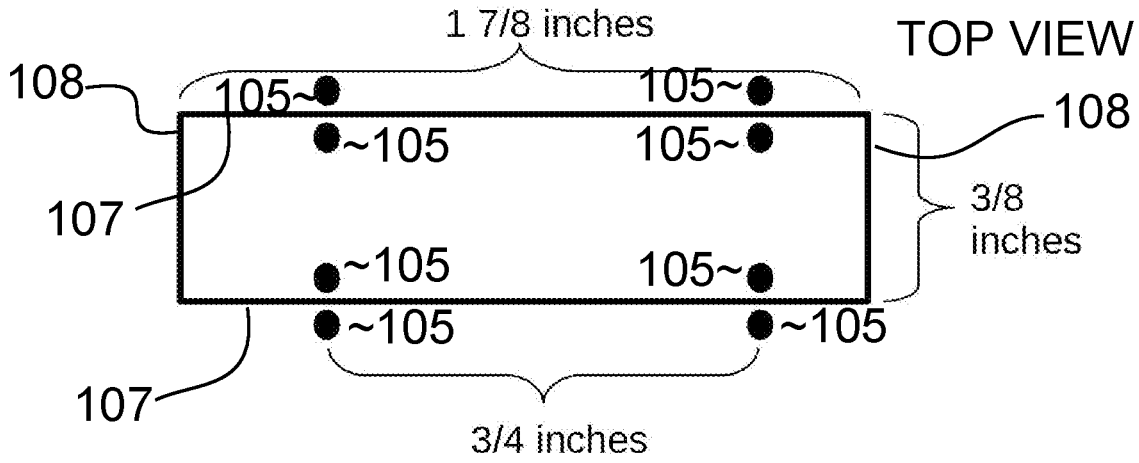
FIG. 1B is an enlarged view of a portion of a pair of divider strips, according to an embodiment.
Figure 1B:
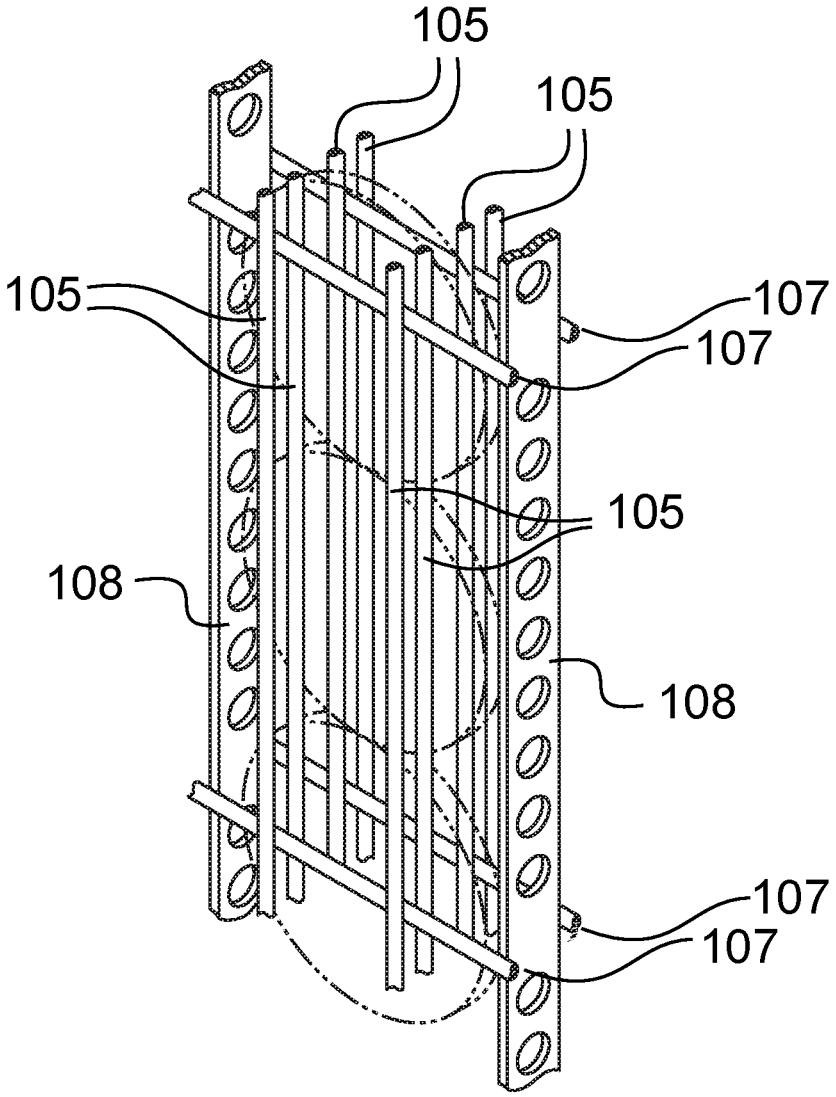

FIG. 1B is an enlarged view of a portion of a pair of divider strips, according to an embodiment.

Shown is pair of divider strips 108, the divider strips 108 having chips 500 between them. Also shown are eight vertical bars 105 and four horizontal bars 107. The divider strips 108, vertical bars 105, and horizontal bars 107 all cooperate to secure the chips therein. This structure also enables a large surface area of each chip to be exposed so that the ultrasonic cleaning process can work on each chip by allowing the cleaning solution to physically contact most of the surface of each chip. Note that the area between the two shown divider strips 108 and two of the vertical bars 105 in a front of a chip (touching the chip) and two of the vertical bars 105 in a rear of the chip (touching the chip) can define a slot into which a chip or chips may be dropped. the spacing if the vertical bars and the divider strips 108 to define the slot would be spaced to fit a casino chip so that a casino chip can slide down the slot due to the force of gravity. However, the spacing is not too large as to allow the chips inside the slot to overlap or have excessive movement. A casino chip is typically 39 mm, 43 mm, or 1⅝ inches in diameter (and can be approximately 3.5 mm thick). Thus, the spacing in each slot should be slightly larger than this in width and length (e.g., 1-8 mm larger or other amount) in order to comfortably accommodate casino chips without excess room in each slot.

Note that the structure illustrated in FIG. 1B repeats itself in order to create the entire basket as shown in FIG. 1A. Three vertical chips are shown in FIG. 1B but the basket 100 can hold eight vertical chips as well as eight chips in the length direction and ten chips in the width direction (for a total of 640 chips). Thus, the structure shown in FIG. 1B repeats itself in all three directions to accommodate all 640 chips. Note that another divider strip would be adjacent to the horizontal bar 107, so the sequence (in the width direction) would be horizontal bar 107, divider strip 108, horizontal bar 107, divider strip 108, etc. The width direction is the axis which has ten chips (height has eight chips and length has eight chips). Note that the horizontal bars (also can be referred to as cross-bars) can be any diameter such as 1/16 of an inch. Note that the vertical bars can be any diameter, such as ⅛ of an inch. On the top of FIG. 1B is a top view of a slot with example dimensions. As stated herein, all dimensions given are just one example, but it can be appreciated that other dimensions can be used as well.

Figure 2:
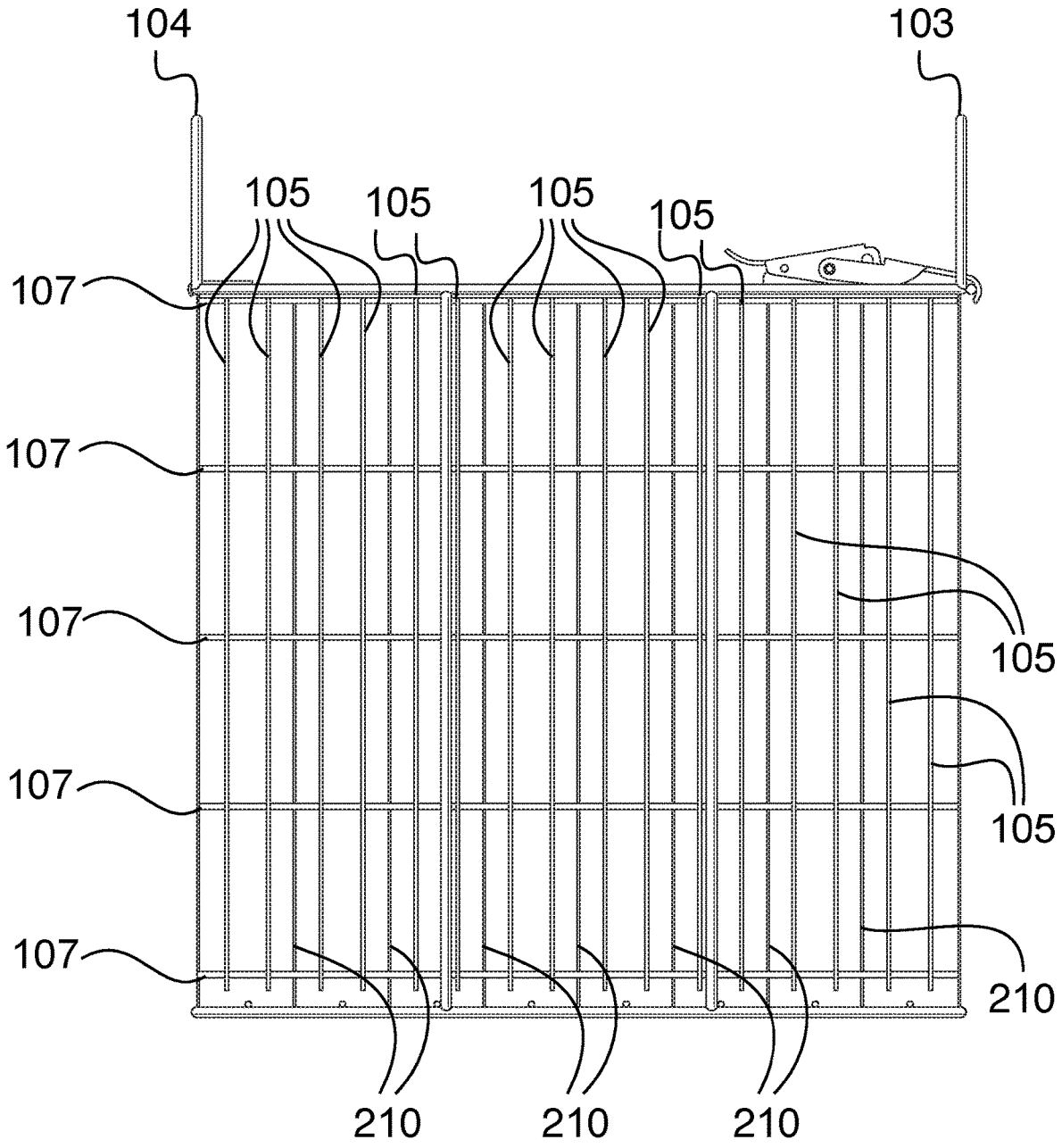
FIG. 2 is a side view of the empty chip washing basket, according to an embodiment.

FIG. 2 is a side view of the empty chip washing basket, according to an embodiment.

A divider panel 210 can comprise ten divider strips 108 (with a horizontal bar 107 between them). There are seven divider panels 210 in the basket 100, with each divider panel 210 separating each chip from its horizontal chip neighbor(s). A divider panel 210 is a two dimensional structure (in the sense that a piece of paper is two dimensional but technically is three dimensional) and it serves to hold the horizontal sides of the casino chips in place inside the basket 100 (see FIG. 1B). Note that the divider panel 210 has circular holes throughout (although any shape can be used), although the circular holes are actually in the divider strips 108 but since the divider panel 210 is comprised of the divider strips 108 these circular holes can also be considered in the divider panel 210. Thus, with seven divider panels 210, the front panel 101, and back panel 102, can accommodate eight chips in the length direction of the basket 100.

Chips can physically contact their vertical chip neighbor(s), in other words, a chip would physically contact any chip directly above it and any chip directly below it. Vertical bars 105 are vertical bars that hold the front and back of the casino chips in place. The horizontal bars 107 also serve to support the structural integrity of the basket 100. Note that since FIG. 2 is a side view, the labeled vertical bars 105 include all of the aligned vertical bars 105, however only the closest vertical bar 105 is visible in FIG. 2. The labeled horizontal bars 107 include all of the aligned horizontal bars 107, however, only the closest horizontal bar 107 is visible in FIG. 2.

Note that each divider strip can be 0.25 inches wide, 13 inches long and 0.05 inches thick (or any other size. The overall dimensions of the basket 100 can be 13.5 inches long, 4.5 inches wide, and 13.125 inches high, although it can be appreciated that such a basket can be constructed to accommodate other numbers and/or sizes of chips and can be made in other dimensions as well.

Figure 3:
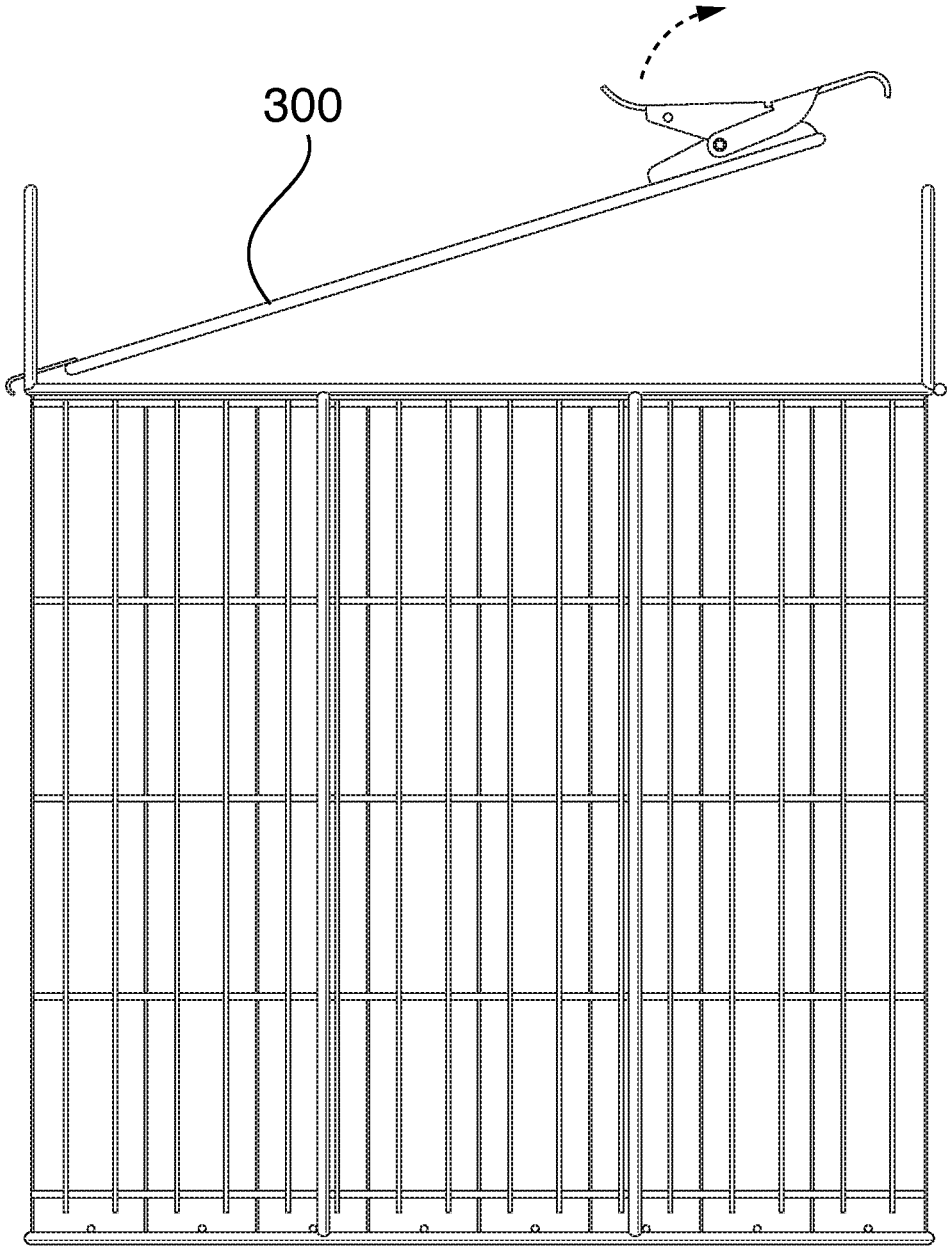
FIG. 3 is a drawing of the empty chip washing basket with its lid being removed, according to an embodiment.

FIG. 3 is a drawing of the empty chip washing basket with its lid being removed, according to an embodiment.

A lid 300 is shown being removed from the basket 100. If the lid 200 was previously locked (secured) onto the top of the basket 100 by the clasp 102, then the handle on the clasp 102 was lifted in order to loosen the clasp 102 from the rod in order to be able to raise the lid 300.

Figure 4:
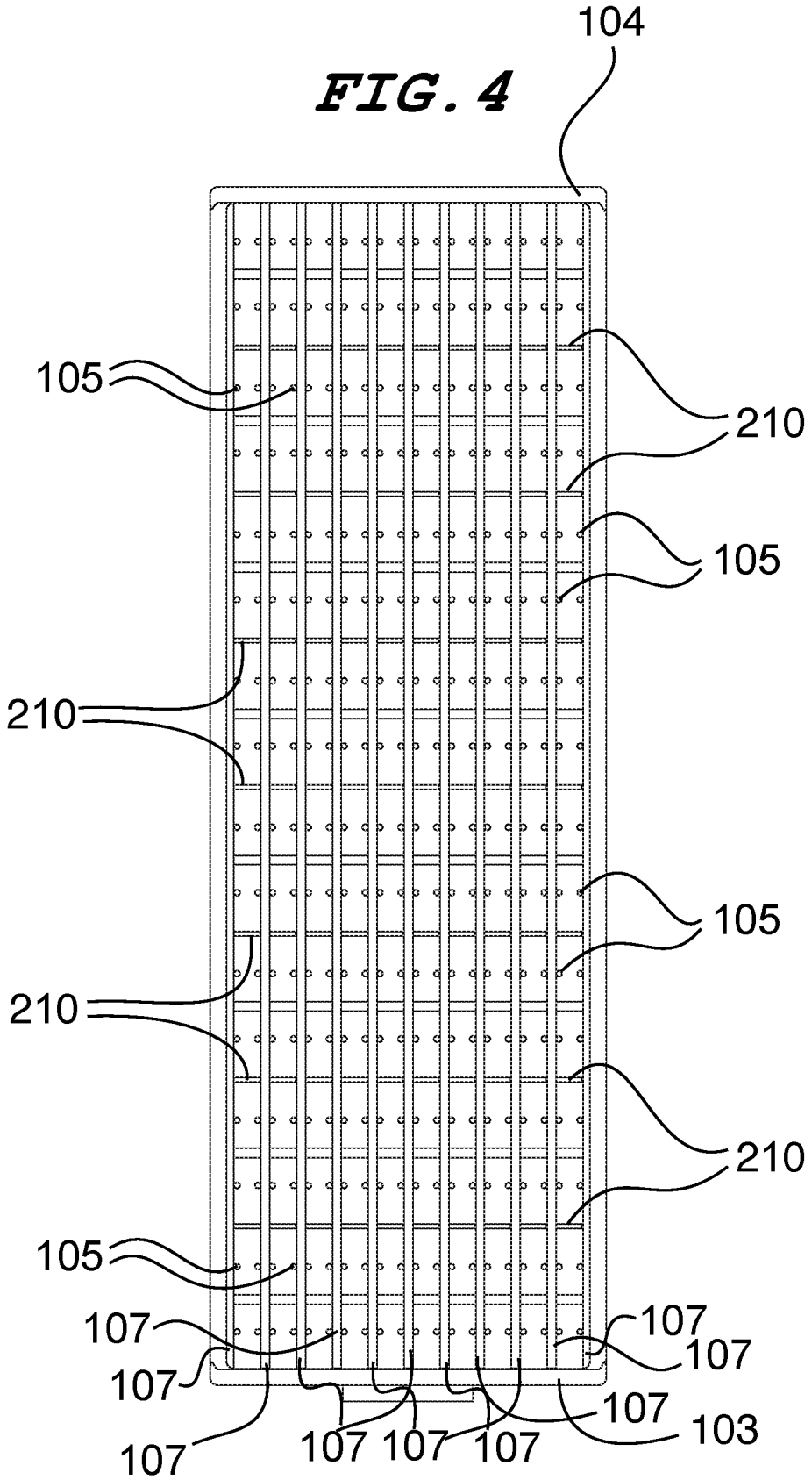
FIG. 4 is a drawing of a top view of the empty chip washing basket with its lid removed, according to an embodiment.

FIG. 4 is a drawing of a top view of the empty chip washing basket with its lid removed, according to an embodiment.

A lid 300 is shown being removed from the basket 100. If the lid 200 was previously locked (secured) onto the top of the basket 100 by the clasp 190, then the handle on the clasp 102 was lifted in order to loosen the clasp 190 from the rod in order to be able to raise the lid 300.

Also shown are a plurality of vertical bars 105. Note that only a small number of the vertical bars 105 in FIG. 4 are numbered, however note that there are 320 (20 width times 16 length) vertical bars shown in FIG. 4. The vertical bars 105 hold the front and back of the casino chips in place. Also numbered is eleven sets of horizontal bars 107.

Figure 5:
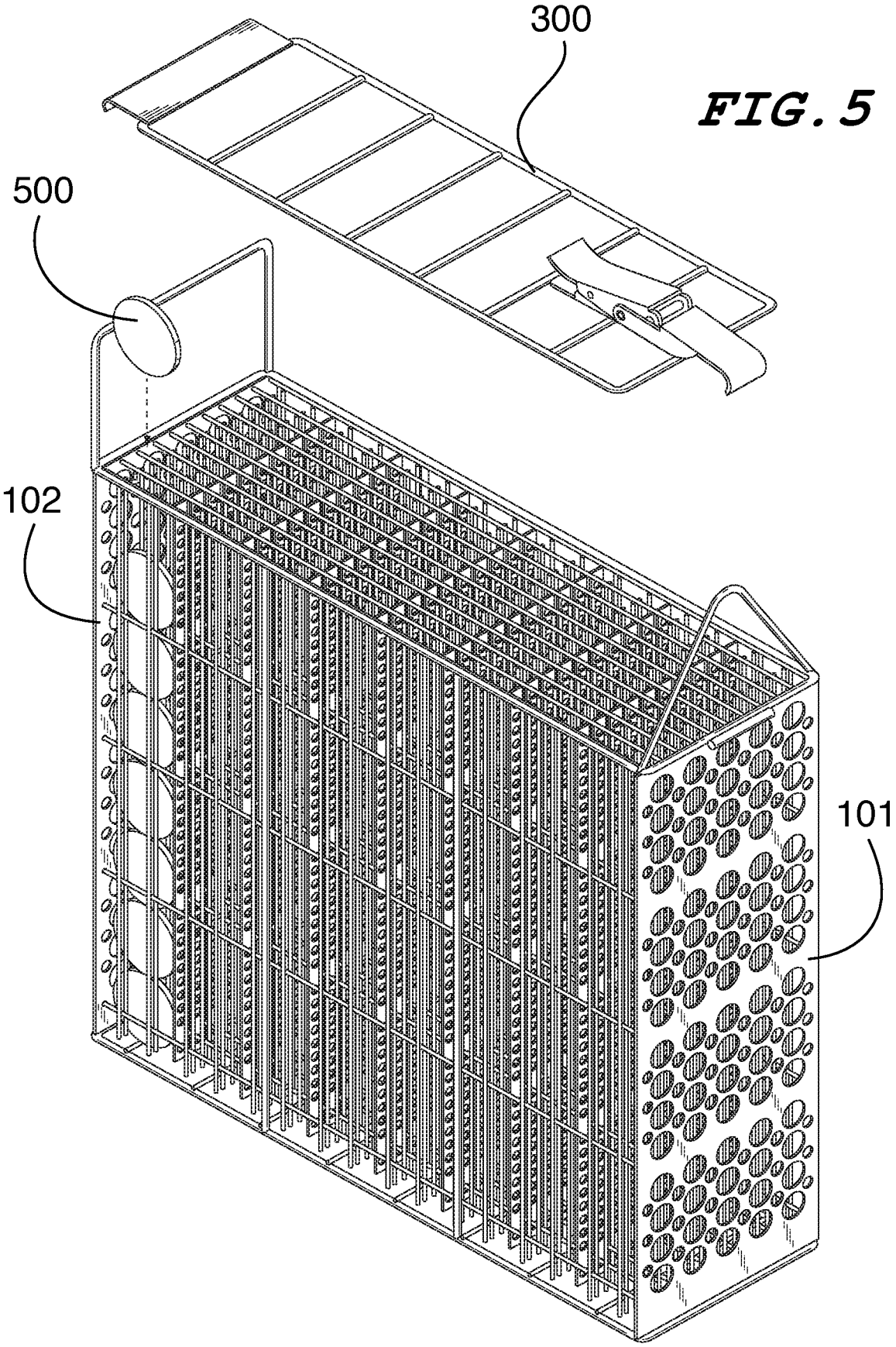
FIG. 5 is an isometric drawing of the empty chip washing basket with its lid exploded and chips being loaded, according to an embodiment.

FIG. 5 is an isometric drawing of the empty chip washing basket with its lid exploded and chips being loaded, according to an embodiment.

Note that the casino chips 500 can be dropped into the basket 100 as shown. As they are dropped in each slot, they will stack over the chips below the one being dropped (in the sense that the checkers in a "CONNECT 4" game drop). There are 80 (ten by eight) slots into which chips can be dropped. Each slot comprises respective vertical bars which guides the chip to fall down in that slot until the chip reaches the bottom of the basket 100 (the first chip) or the chip rests on top of a highest chip in the slot. Each chip 500 has two vertical bars in front and behind the chip 500. The 80 chips on the very left side of FIG. 5 have back panel 102 on their left and a divider panel 210 on their right. The 80 chips on the very right side of FIG. 5 have front panel 101 on their right side and a divider panel on their left. All of the other chips inside the basket 100 will have a divider panel 210 on their left and a divider panel 210 on their right.

Figure 6:
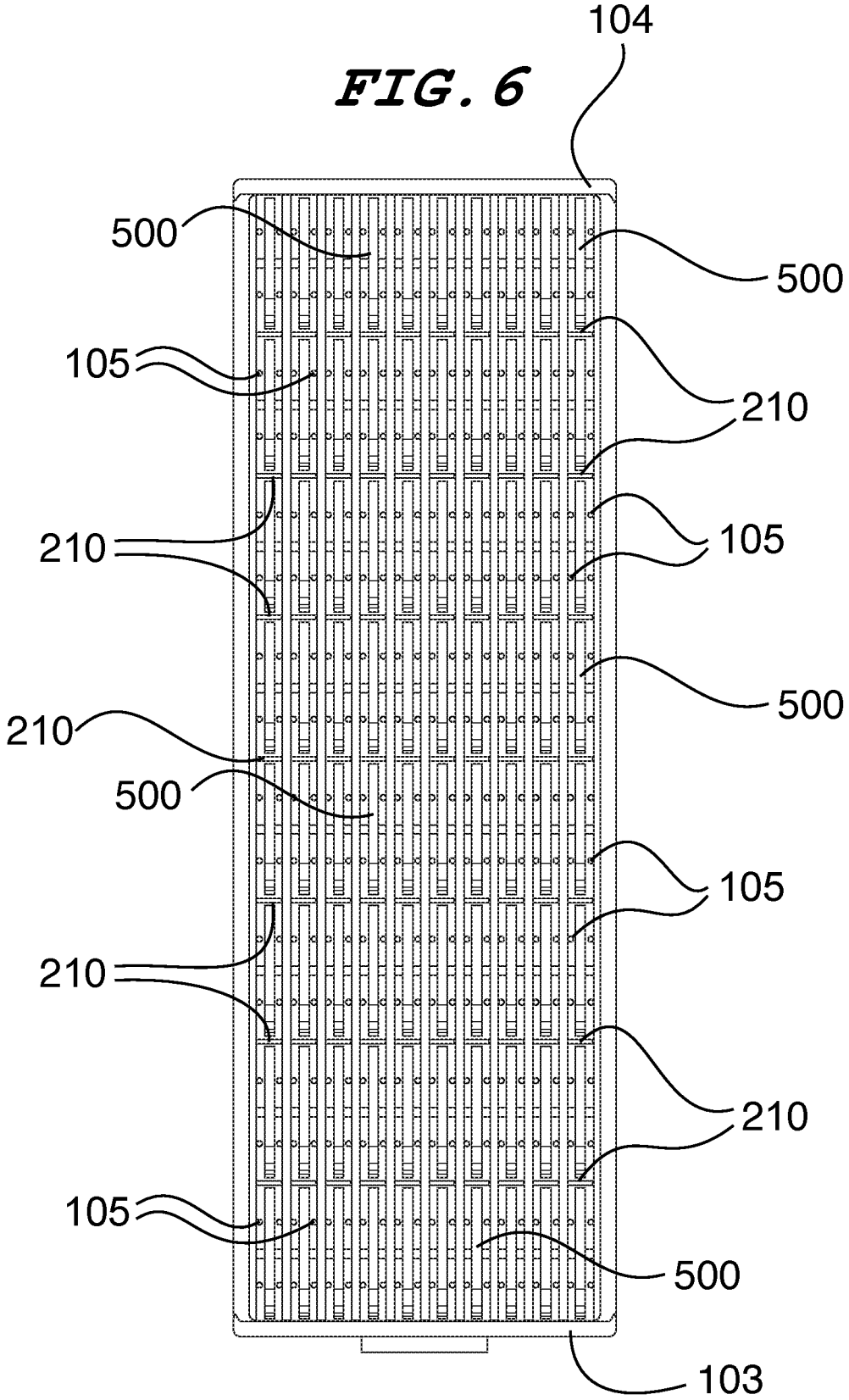
FIG. 6 is top plan view of the chip washing basket with lid removed with all chips loaded, according to an embodiment.

FIG. 6 is top plan view of the chip washing basket with lid removed with all chips loaded, according to an embodiment.

The seven divider panels 210 and vertical bars 105 are shown. Note that only some vertical bars 105 are numbered. Note that only some chips 500 are numbered, although 80 chips are visible in this view (the rest of the chips being behind the visible chips). This view is similar to FIG. 4 but with all 640 chips 500 loaded into the basket 100.

The slots the chips are dropped in are arranged in a grid of rows and columns. It can be considered that the columns run from the front panel 101 to the back panel 102, and the rows (perpendicular to the columns) run from the left side of the basket 100 to the right side of the basket 100. The basket has ten rows and eight columns (total of 80 slots). Each slot is eight chips deep. Note that the bars used to form the top (and bottom) of the basket 100 can be of any diameter, such as ⅛ of an inch. Note that all bars (and all other parts such as the divider strips) can be made of any suitable material, such as stainless steel, and all bars can be any size (⅛ inch, 1/16 inch, or any other size). All connected bars can be welded together or any other attachment mechanism. All parts that are touching in the figures can be assumed to be connected at some point(s), as the basket is sturdy and stable, and (aside from the removable lid) does not contain any moving parts.

Figure 7:
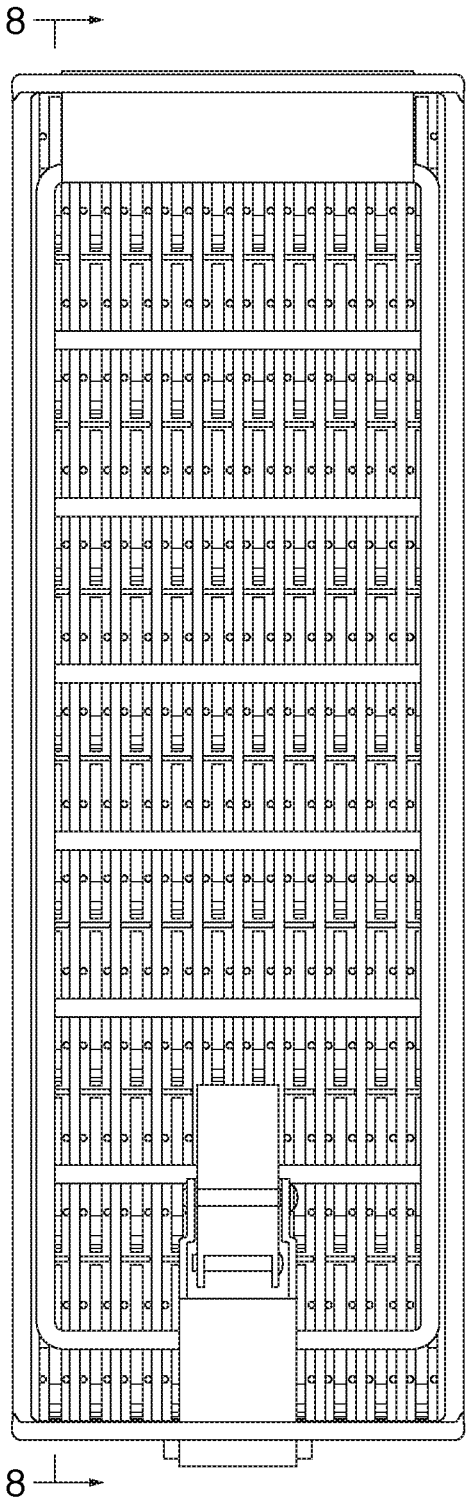
FIG. 7 is a top plan view of the chip washing basket with its lid in place with all chips loaded, according to an embodiment.

FIG. 7 is a top plan view of the chip washing basket with its lid in place with all chips loaded, according to an embodiment.

This view is the same as FIG. 6 but with the lid 300 secured onto the top of the basket 100. The lid 300 should be secured on the top of the basket 100 before the basket is loaded into an ultrasonic cleaner so that the lid 300 does not become dislodged and fall off the basket 100.

Figure 8:
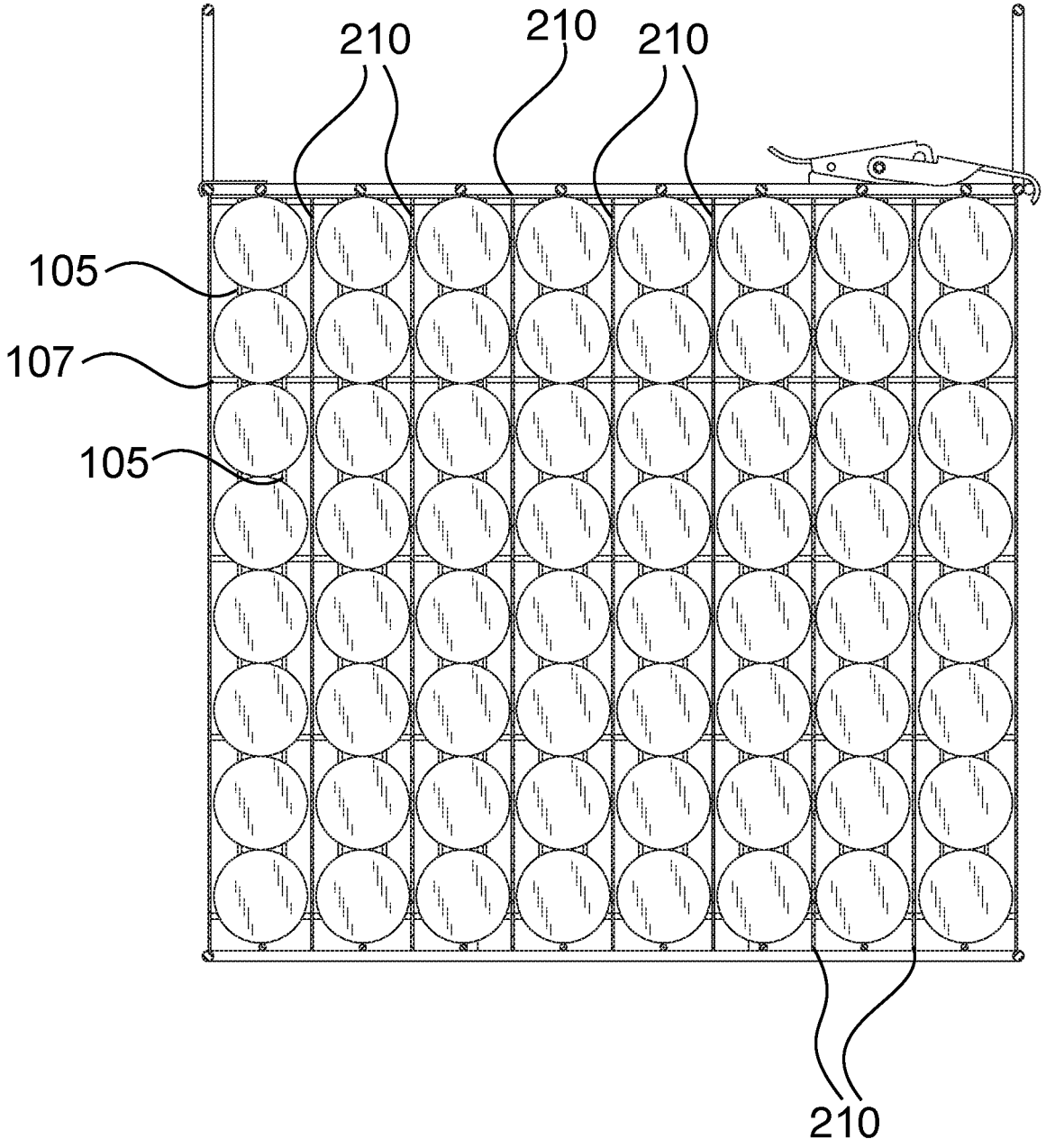
FIG. 8 is a cross-section of one vertical plane of chips in the chip washing basket taken from the view shown in FIG. 7, according to an embodiment.

FIG. 8 is a cross-section of one vertical plane of chips in the chip washing basket taken from the view shown in FIG. 7, according to an embodiment.

Note that the vertical bars 105 are visible behind the chips shown, with only some of the vertical bars 105 being labeled in FIG. 8. Note that horizontal bars 107 are visible with only some of the horizontal bars 107 being labeled in FIG. 8.

The basket 100 is made of any suitable materials, such as hard plastic, stainless steel, or any other metals. However, some materials such as aluminum may not withstand the ultrasonic cleaning process well and as such would not be ideal to use to form the basket 100. All of the parts of the basket 100 can connected together (integrated) by welding, adhesives (e.g., glue) or any other permanent attaching mechanisms. All of the parts of the basket 100 (this does not include the chips) are integrated together except for the lid 300 which can be removed. The basket 100 should be durable and sturdy and will maintain its structural integrity even though it is placed under a high stress environment inside an ultrasonic cleaner.

Figure 9:
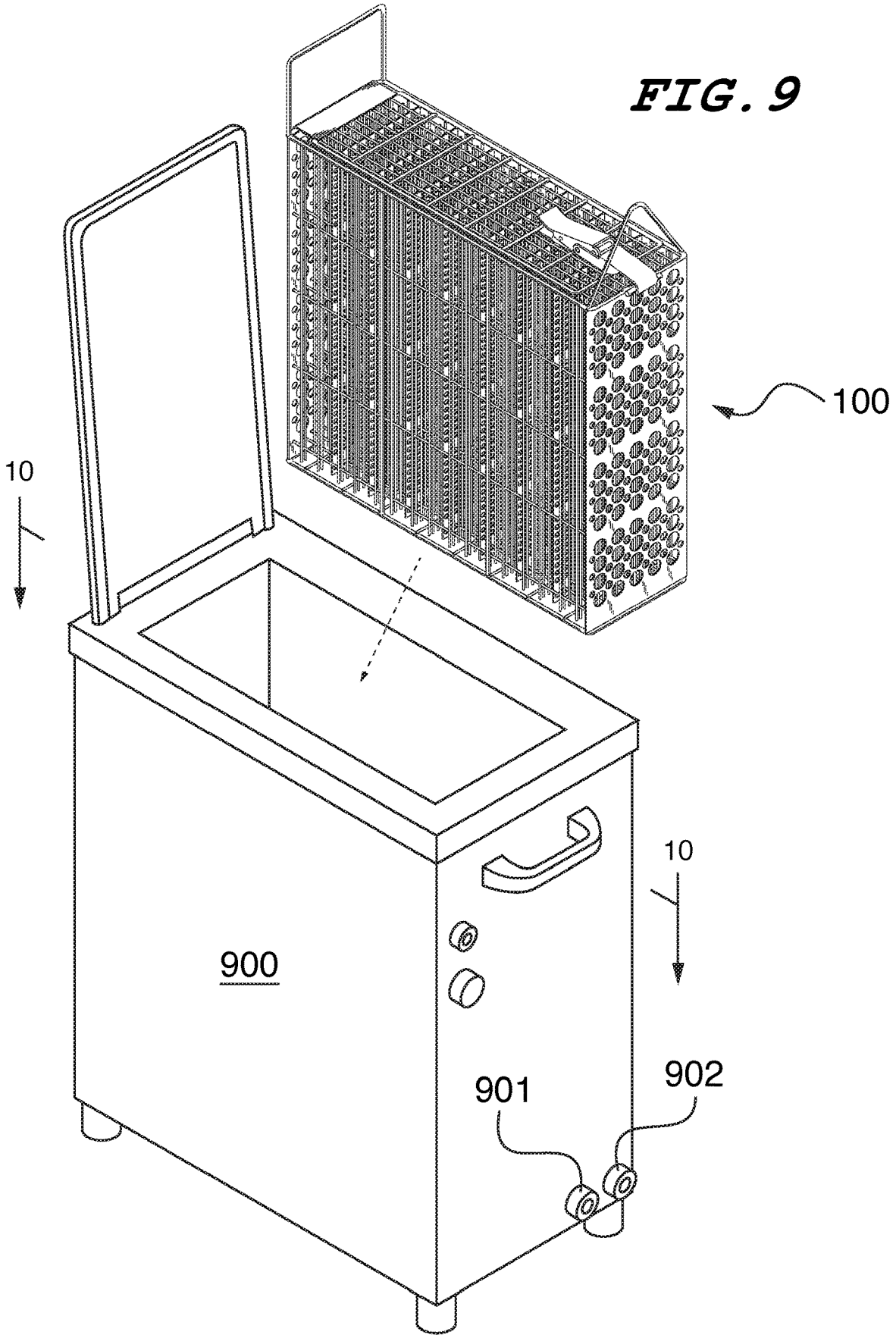
FIG. 9 is an exploded isometric drawing of the chip washing basket being placed into an ultrasonic washer, according to an embodiment.

FIG. 9 is an exploded isometric drawing of the chip washing basket being placed into an ultrasonic cleaner/tank, according to an embodiment.

An ultrasonic cleaner 900 is capable of cleaning objects placed inside using known ultrasonic cleaning technology. A generator power cord 901 is used to power the ultrasonic generator (including the transducers 1000) in the ultrasonic cleaner 900. A heater power cord 902 is used to power a heater inside the ultrasonic cleaner 900 which heats the water/cleaning solution inside the cleaner 900. Once the basket 100 is placed inside the ultrasonic cleaner 900, and the inside of the ultrasonic cleaner is filled with water and ultrasonic cleaning solution, the ultrasonic cleaner may then be closed. The ultrasonic cleaner can be activated and begin the ultrasonic cleaning process.

Figure 10:
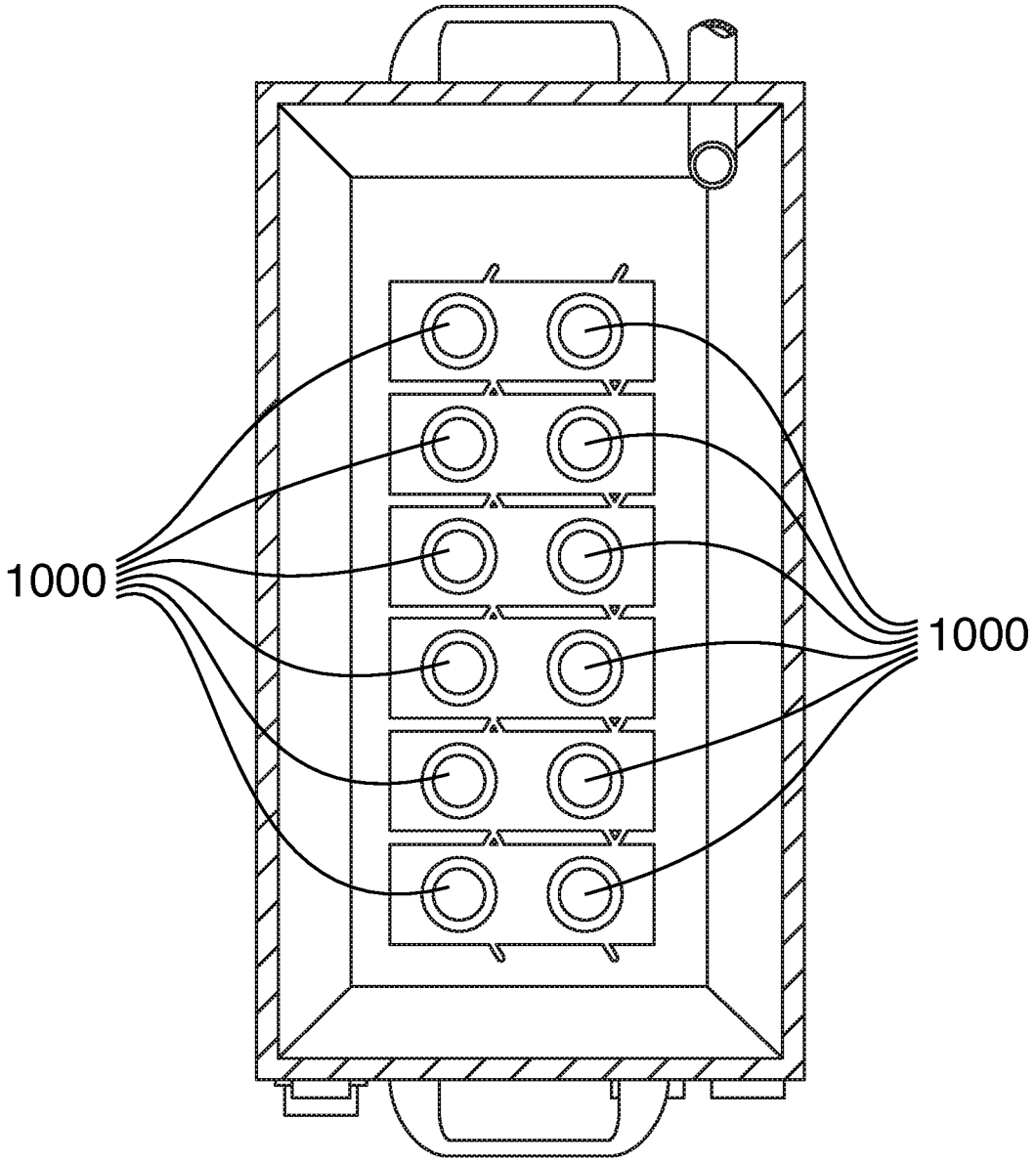
FIG. 10 is a cross-section of the ultrasonic washer showing a transducer array taken from the view shown in FIG. 9, according to an embodiment.

FIG. 10 is a cross-section of the ultrasonic washer showing a transducer array taken from the view shown in FIG. 9, according to an embodiment.

Note the twelve transducers 1000 on the bottom of the ultrasonic cleaner 900, which are used to generate the ultrasonic waves which cause the ultrasonic cleaning action.

Figure 11:
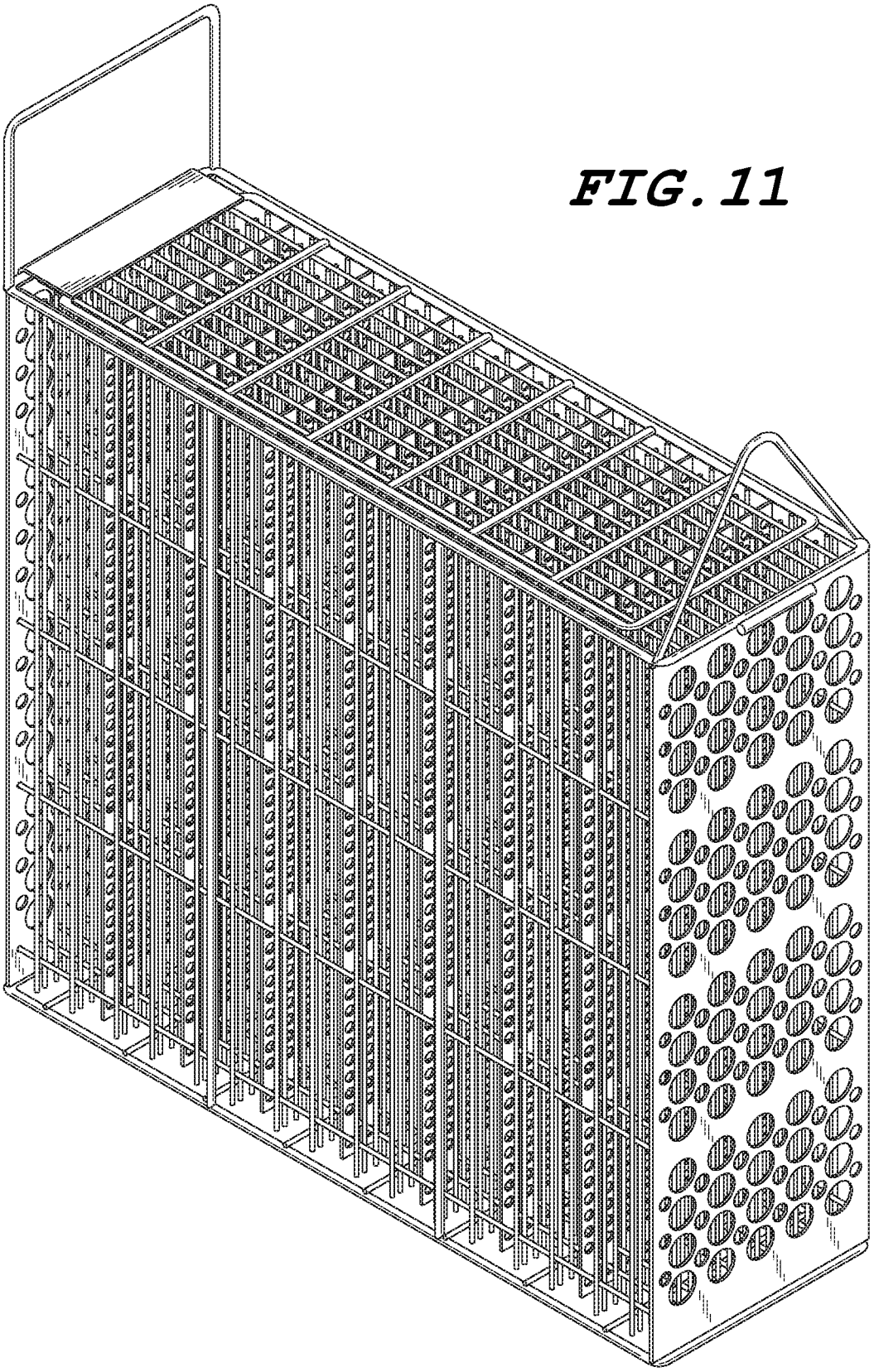
FIG. 11 is an isometric view of a basket with no clasp, according to an embodiment.
Figure 12:
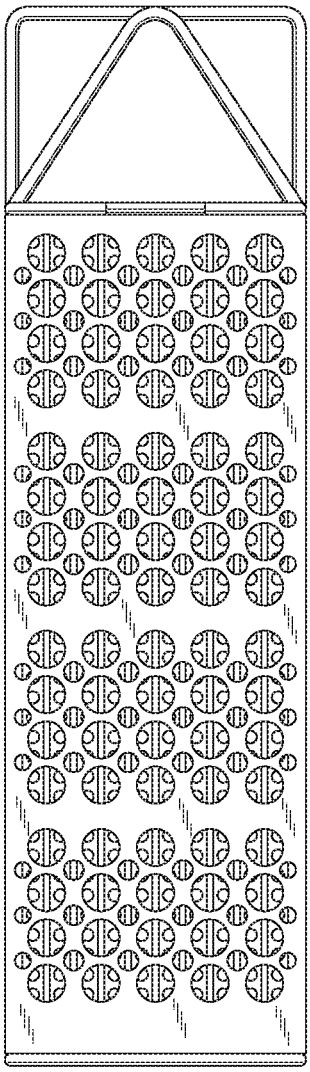
FIG. 12 is a front view of the basket with no clasp, according to an embodiment.
Figure 13:
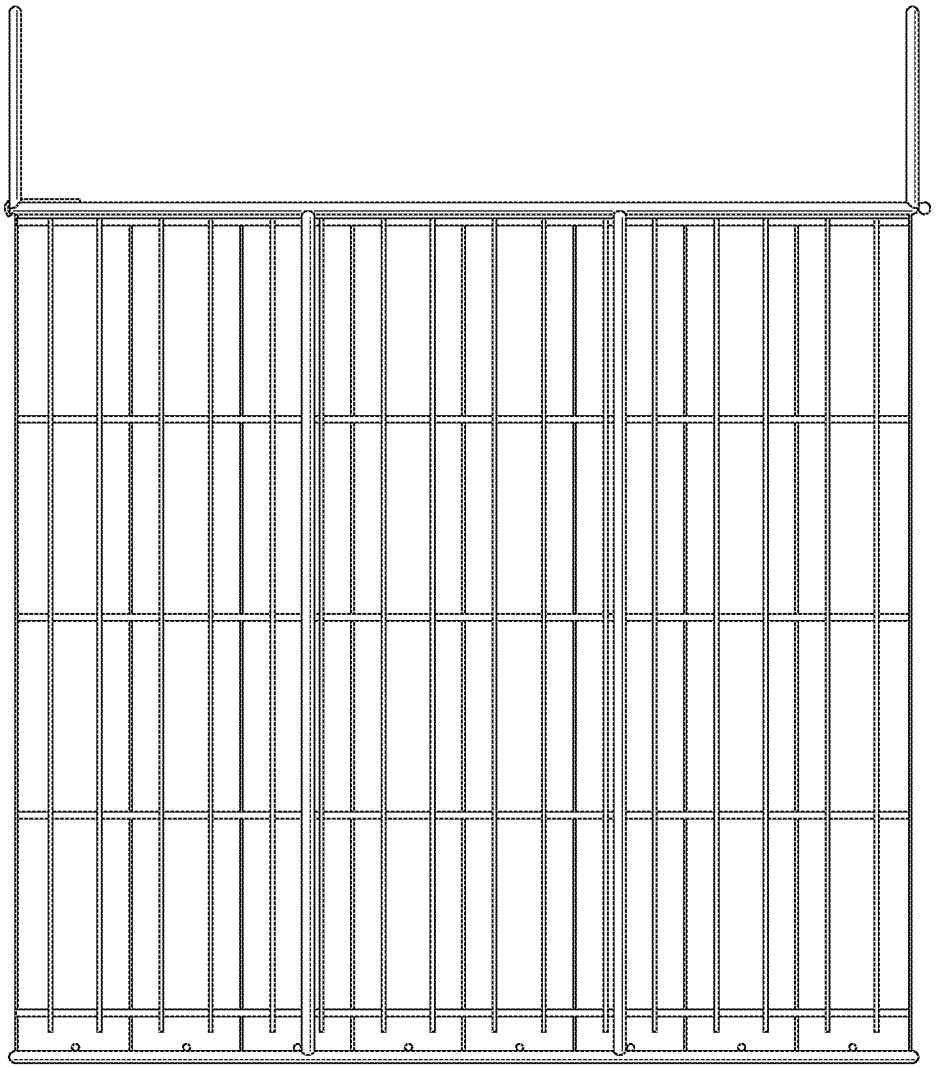
FIG. 13 is a left view of the basket with no clasp, according to an embodiment.
Figure 14:
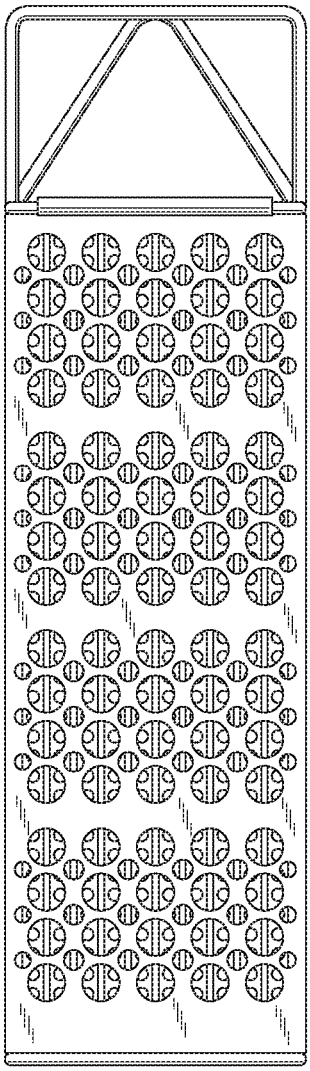
FIG. 14 is a rear view of the basket with no clasp, according to an embodiment.
Figure 15:
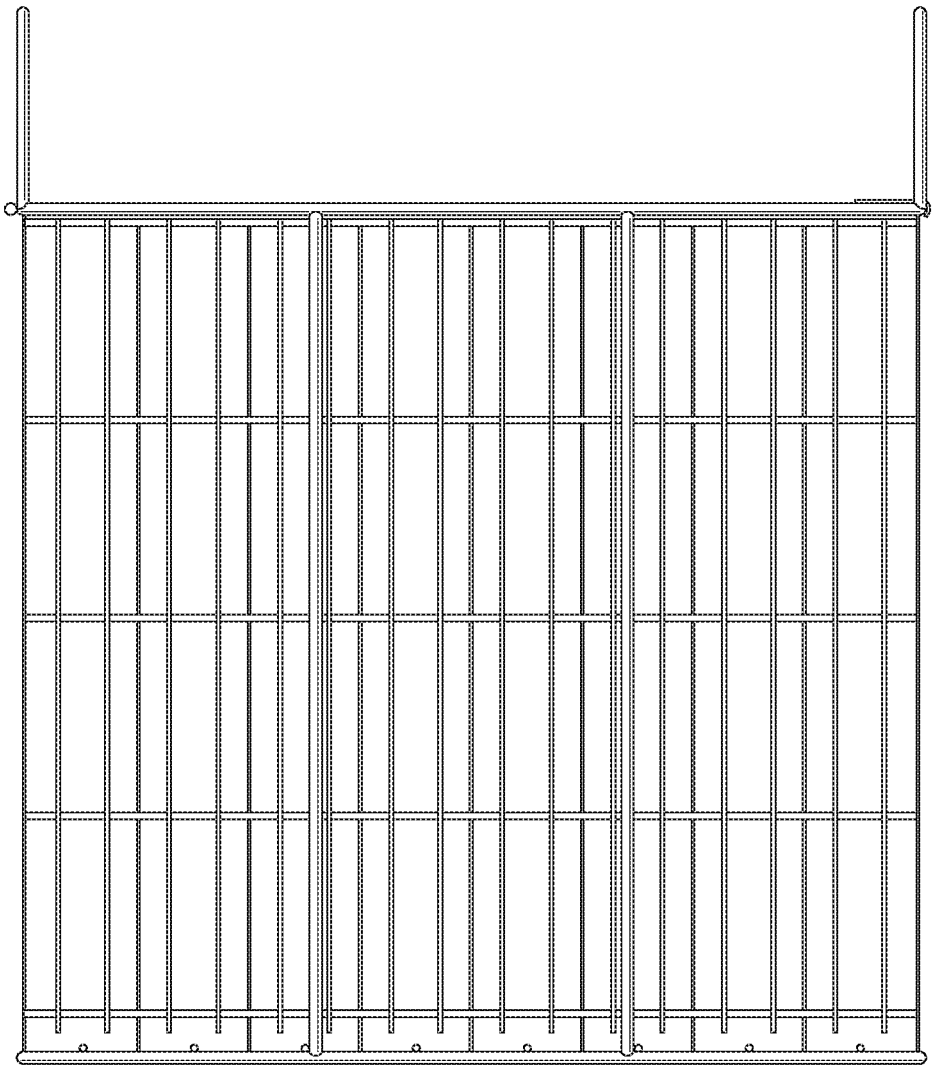
FIG. 15 is a right view of the basket with no clasp, according to an embodiment.
Figure 16:
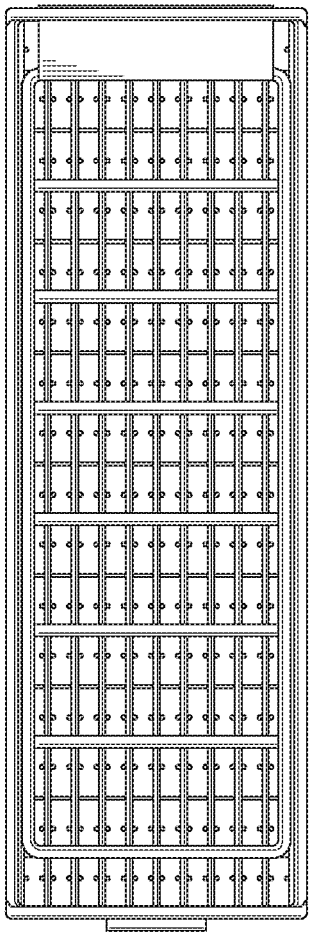
FIG. 16 is a top view of the basket with no clasp, according to an embodiment.
Figure 17:
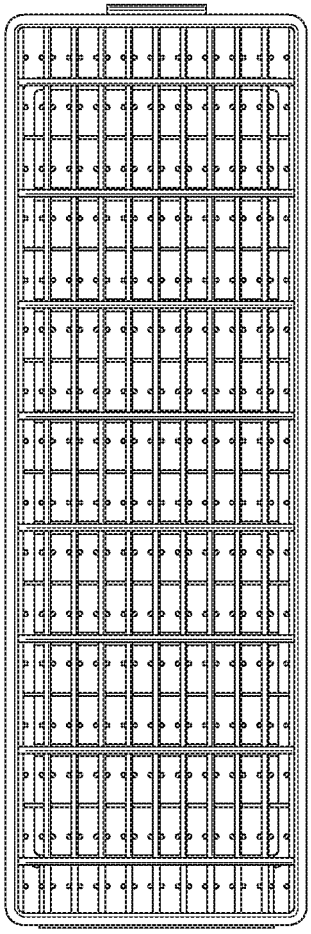
FIG. 17 is a bottom view of the basket with no clasp, according to an embodiment.

FIG. 11 is an isometric view of the basket with no clasp, according to an embodiment. Note that there should be a mechanism to seal the lid onto the basket (any such mechanism can be used), nevertheless some figures are now presented without showing any such closure mechanism. FIG. 12 is a front view of the basket with no clasp, according to an embodiment. FIG. 13 is a left view of the basket with no clasp, according to an embodiment. FIG. 14 is a rear view of the basket with no clasp, according to an embodiment. FIG. 15 is a right view of the basket with no clasp, according to an embodiment. FIG. 16 is a top view of the basket with no clasp, according to an embodiment. FIG. 17 is a bottom view of the basket with no clasp, according to an embodiment.

The basket described and illustrated herein is intended to be used with an ultrasonic cleaning system. The basket 100 is designed to expose as much of the surface area of each chip as possible so that cleaning agents in an ultrasonic cleaning system can best work on the entire surface of each chip. Ultrasonic cleaners are known in the art, for example see U.S. patent publication 2017/0036251 An ultrasonic cleaner generally works by utilizing ultrasound generating transducers which produce ultrasonic waves in the fluid. This creates compression waves in the liquid which cause 'partial vacuum bubbles (cavitation) which remove dirt and contaminants on subject objects being cleaned inside an ultrasonic cleaner.

Figure 18:
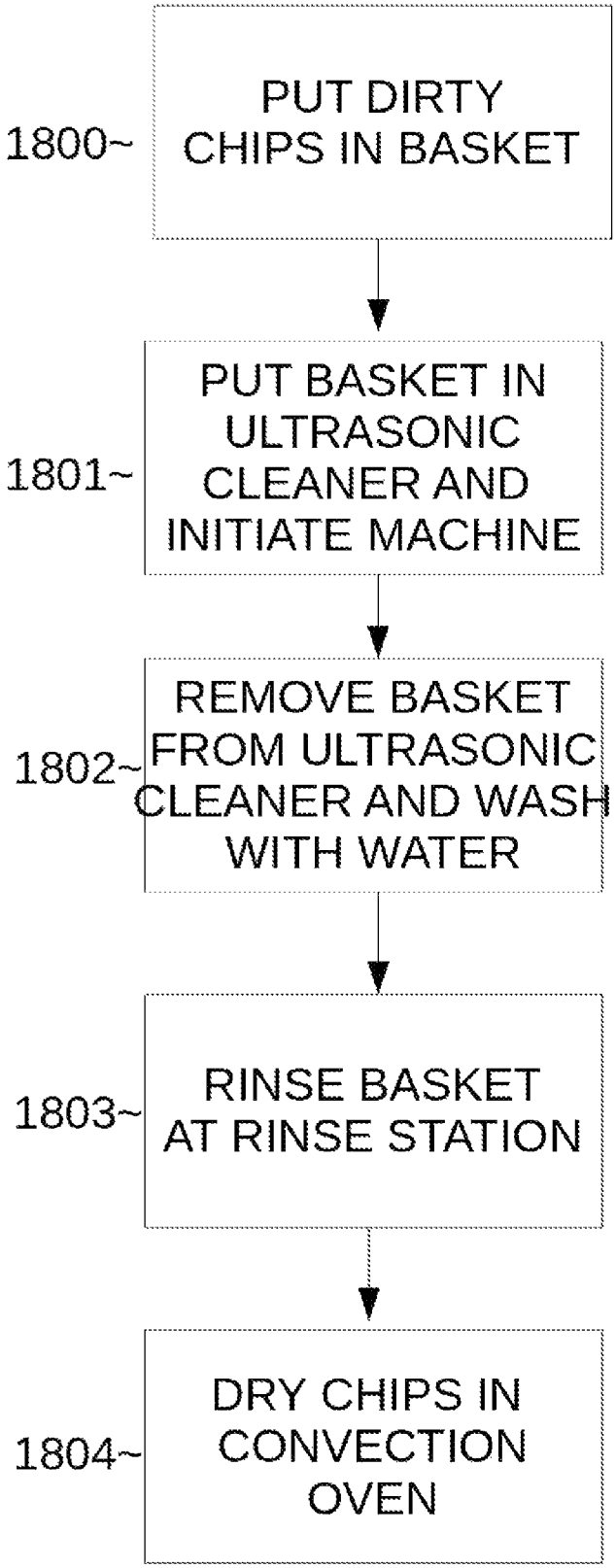
FIG. 18 is a flowchart illustrating an exemplary method of washing casino chips, according to an embodiment.

FIG. 18 is a flowchart illustrating an exemplary method of washing casino chips, according to an embodiment.

The method can begin with operation 1800, in which an operator (user) loads up the basket 100 with chips. The operator would drop the chips into the basket 100 until the basket 100 is full (or all of the chips the operator has are in the basket 100). The chips can be inserted into slots in the basket 100 one by one.

From operation 1800, the method proceeds to operation 1801, in which the operator loads the basket 100 into an ultrasonic cleaner. Ultrasonic cleaning solution should be added, for example the solution can be a combination of dishwashing detergent plus antibacterial soap. Any other cleaning solution can be used as well, and ultrasonic cleaning solutions are widely available over the counter, as are the ultrasonic cleaner machines themselves. The cleaning solution would be added to water inside the cleaner so that basket would be immersed in the aqueous solution.

The ultrasonic cleaner can then be powered on and the machine can then operate for a period of time (e.g., 30 minutes to three hours or longer) until the casino chips are adequately clean. The ultrasonic cleaner should ideally have a heater as well as ultrasonic transducers, the heater would heat up the solution inside the ultrasonic cleaner which assists in the cleaning solution.

From operation 1801, once the ultrasonic cleaner has finished, the method proceeds to operation 1802, in which the operator removes the basket form the ultrasonic cleaner. The operator can then manually rinse off the basket with water to try to remove the soap/ultrasonic cleaning solution.

From operation 1802, the method proceeds to operation 1803, wherein the basket 100 can then be moved to a rinse station. A rinse station can comprise a hose (which can emit water at high pressure) and a drain. The operator can rinse off the basket with the hose for a period of time (e.g., 15 minutes) until most or all of the cleaning solution has been washed out of the basket and chips.

From operation 1803, the method can proceed to operation 1804, in which the chips can be dried inside an oven such as a convention oven. At this point the chips should still all be inside the basket 100. The basket 100 can be placed inside the oven. The oven can be set at a high temperature, for example over 140 degrees could kill certain viruses such as norovirus). The oven will evaporate the water and dry the chips out, and can also serve to sanitize the chips. Once the chips are dry, the basket can be removed from the oven and the chips can be removed from the basket 100 (by removing the lid 300 and the pouring the chips out of the basket 100).

The many features and advantages of the invention are apparent from the detailed specification and, thus, it is intended by the appended claims to cover all such features and advantages of the invention that fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

What is claimed is:

1. A chip washing basket, comprising:

a front panel comprising a continuous sheet comprising a plurality of front panel holes;

a back panel comprising a continuous sheet comprising a plurality of back panel holes;

a plurality of horizontal bars connecting the front panel and the back panel;

a plurality of slots comprising a plurality of vertical bars, the slots arranged in rows and columns; and a plurality of divider panels, each divider of the plurality of divider panels between rows of slots, wherein the divider panels comprise divider panel holes.

2. The basket as recited in claim 1, wherein the front panel holes are of at least two different sizes.

3. The basket as recited in claim 2, wherein the back panel holes are of at least two different sizes.

4. The basket as recited in claim 1, wherein the front panel holes are circles.

5. The basket as recited in claim 1, wherein the front panel holes are circles of at least two different sizes.

6. The basket as recited in claim 1, wherein each of the plurality of divider panels comprises a plurality of divider strips.

7. The basket as recited in claim 6, wherein the divider panel holes are located in the plurality of divider strips.

8. The basket as recited in claim 7, wherein between each pair of adjacent divider strips in a same divider panel is a horizontal bar.

9. A chip washing basket, comprising:

a front panel;

a back panel;

a grid of slots comprising rows and columns of slots;

each slot in the grid of slots comprising a plurality of vertical bars in a front and a plurality of vertical bars in a rear of the slot, the vertical bars configured to restrain a casino chip;

a pair of horizontal bars connecting the front panel and the back panel;

a plurality of divider strips between the pair of horizontal bars.

10. The chip basket as recited in claim 9, further comprising a plurality of holes in the front panel.

11. The chip basket as recited in claim 10, further comprising a plurality of holes in the back panel.

12. The chip basket as recited in claim 9, wherein the plurality of vertical bars in the front contact a first bar in the pair of horizontal bars, and the plurality of vertical bars in the rear contact a second bar in the pair of horizontal bars.

13. A method, comprising:

providing a basket comprising: a front panel comprising a continuous sheet comprising a plurality of front panel holes; a back panel comprising a continuous sheet comprising a plurality of back panel holes; a plurality of horizontal bars connecting the front panel and the back panel; a plurality of slots comprising a plurality of vertical bars, the slots arranged in rows and columns; a plurality of divider panels, each divider of the plurality of divider panels between rows of slots, wherein the divider panels comprise divider panel holes;

loading the basket with casino chips;

inserting the basket in an ultrasonic cleaner and activating the cleaner; and removing the basket and drying the casino chips.

* * * * *